United States Patent [19]

Pokorny

[11] Patent Number: 4,905,328

[45] Date of Patent: Mar. 6, 1990

[54] SOFA-BED ASSEMBLY

[75] Inventor: L. Robert Pokorny, Wading River, N.Y.

[73] Assignee: Louis Pokorny Company, Inc., Ronkonkoma, N.Y.

[21] Appl. No.: 313,991

[22] Filed: Feb. 23, 1989

[51] Int. Cl.[4] ..... A47C 17/04

[52] U.S. Cl. ..... 5/13; 5/29

[58] Field of Search ..... 5/13, 29, 28

[56] References Cited

U.S. PATENT DOCUMENTS 3,284,811 11/1966 Rogers, Jr. ..... 5/13

4,682,375 7/1987 Pokorny ..... 5/13

*Primary Examiner*—Alexander Grosz

*Attorney, Agent, or Firm*—Alan H. Levine

[57] ABSTRACT

A sofa-bed assembly comprising a rear vertical section, a lower horizontal section, a front vertical section, and an upper horizontal section pivoted to one another in succession for folding movement between a collapsed sofa condition and an extended bed contidion. A mattress folded within the assembly presses upwardly against the upper horizontal section, and a locking linkage arrangement resists the tendency of the folded mattress to swing the upper horizontal section upwardly out of a horizontal plane when the assembly is in its collapsed condition. Release of the locking linkage involves initially compressing the mattress further, thereby increasing the force required to open the bed. Additional links respond to unfolding of the rear leg, which supports the unfolded lower horizontal section for relieving some of the pressure of the mattress on the upper horizontal section, thereby reducing the force required to open the locking linkage to permit unfolding of the upper horizontal section. The additional links serve to release the mattress pressure by causing the locked-together upper horizontal section and front vertical section to pivot through a small angle, about the pivot joining the front vertical section and lower horizontal section, in the direction of unfolding of the section.

9 Claims, 5 Drawing Sheets

10
11
12
14
17
18
19
20
21
22
23
26
30
31
32
33
34
35
39
40
41
42
43
48
49
50
51
52
53
60
62
63
64
65
67
68
69
70
71
72
73
74
75
76
77
78
79

10
11
12
14
17
18
19
20
21
22
23
26
27
62
64
65
68
70
71
72
73
74
75
76
77
78
79

SOFA-BED ASSEMBLY

This invention relates to sofa-beds, and has particular reference to reducing the pulling force required to fully unfold the mechanism to its extended bed condition.

The type of sofa-bed mechanism with which the invention is concerned comprises sections that are pivoted to one another in succession and are foldable between a collapsed sofa position and an extended bed position. The sections include two which lie in superposed horizontal planes when the structure is collapsed and in horizontal alignment when the mechanism is extended; they may be conveniently designated upper and lower horizontal sections. Between them, at the front of the sofa, is a front vertical section, and at the rear of the lower horizontal section it is pivotally joined to a rear vertical section, the word "vertical" signifying that in the collapsed or fully folded condition of the mechanism these sections lie in substantially vertical planes. Connecting linkages support the mechanism between the opposed side walls of a rigid sofa body.

U.S. Pat. Nos. 3,284,811 and 4,682,375 show examples of this general kind of assembly. When pulling the collapsed assembly from the sofa body, the rear vertical section and lower horizontal section unfold first, after which the upper horizontal and front vertical sections are unfolded to fully extend the mechanism. In its extended condition the mechanism stretches forwardly from the sofa body to define four aligned bed-defining sections. A mattress, generally coextensive with the mechanism, is foldable within the mechanism when the latter is in its fully collapsed condition, and has sufficient resilience so that is springs open to a flat condition to lie upon the extended bed sections when the mechanism is unfolded.

Originally, the mattresses used in sofa-beds were relatively thin, so that when such a mattress was folded within the collapsed sections, it applied little or no pressure to the sections enclosing it. However, in later years, the trend has been to use of thicker and thicker mattresses, for added sleeping comfort, as a result of which the bulk and inherent resilience of the mattress exerts a considerable upward pressure on the upper horizontal section of the folded mechanism. This pressure has a tendency to swing the upper section upwardly, so that if not restrained the upper section would be tilted out of the desired horizontal seat-cushion-supporting position.

To overcome this problem, locking arrangements of various configurations have been employed to lock at least the upper horizontal section against rotation when the mechanism is collapsed. One type of such locking arrangement is an over center or toggle mechanism, shown in U. S. Pat. No. 3,284,811, which prevents the mattress from causing relative rotation between the upper horizontal section and the front vertical section. While the toggle lock is effective in resisting mattress pressure, it presents its own problem. When the toggle mechanism is moved from its locked position to its unlocked position, the upper horizontal bed section must initially pivot downwardly through a small angle, to permit the toggle to snap past its dead center position. Downward pivotal movement of the upper horizontal section involves further compressing the already highly compressed mattress, as a result of which the force required to open the toggle lock is increased, making complete opening of the mechanism more difficult.

It is an object of the present invention to solve this problem by providing a sofa-bed mechanism, of the type mentioned, wherein during the first stage of opening of the mechanism, i.e., during unfolding of the rear leg which supports the unfolded lower horizontal sections, the pressure of the mattress on the upper horizontal section is relieved. As a result, the force required to open the toggle lock, acting on the upper horizontal section, is reduced.

It is another object of the invention to provide such a sofa-bed mechanism wherein the mattress pressure is relieved by pivoting the upper horizontal and front vertical sections about the pivot joining the front vertical and lower horizontal sections, during the first stage of opening of the mechanism.

Additional objects and features of the invention will be apparent from the following description in which reference is made to the accompanying drawings.

Figure 1:
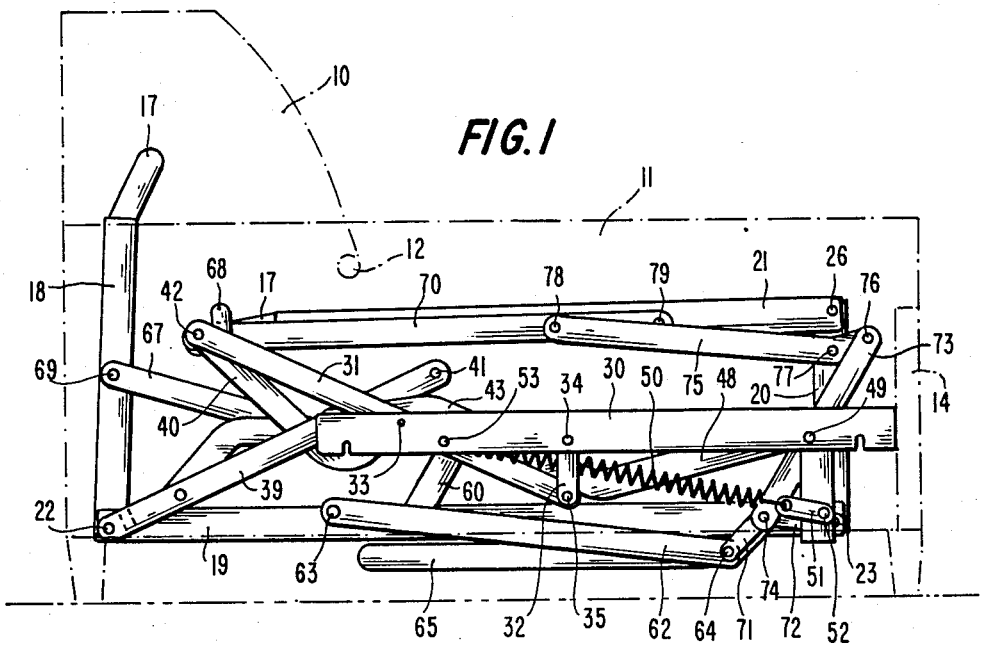
FIG. 1 is a side view of the assembly with the near side of the sofa body omitted to reveal the mechanism within it, the mechanism being shown in its fully collapsed sofa-defining condition, and parts of the sofa body being shown only schematically.
Figure 2:
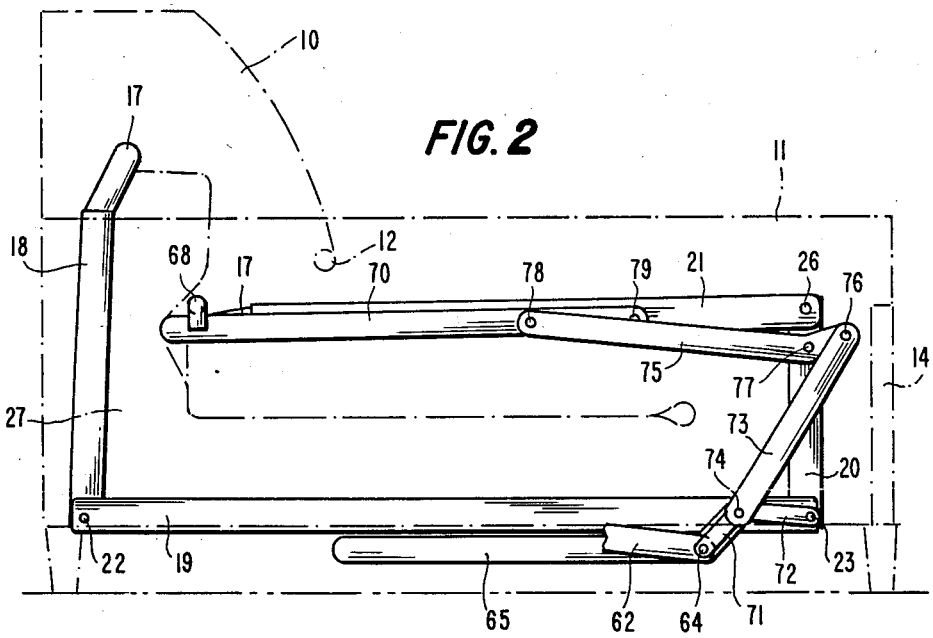
FIG. 2 is a side view of a portion of the sofa-bed mechanism, showing those parts involved with locking the collapsed assembly against opening movement due to pressure of the folded mattress.
Figure 3:
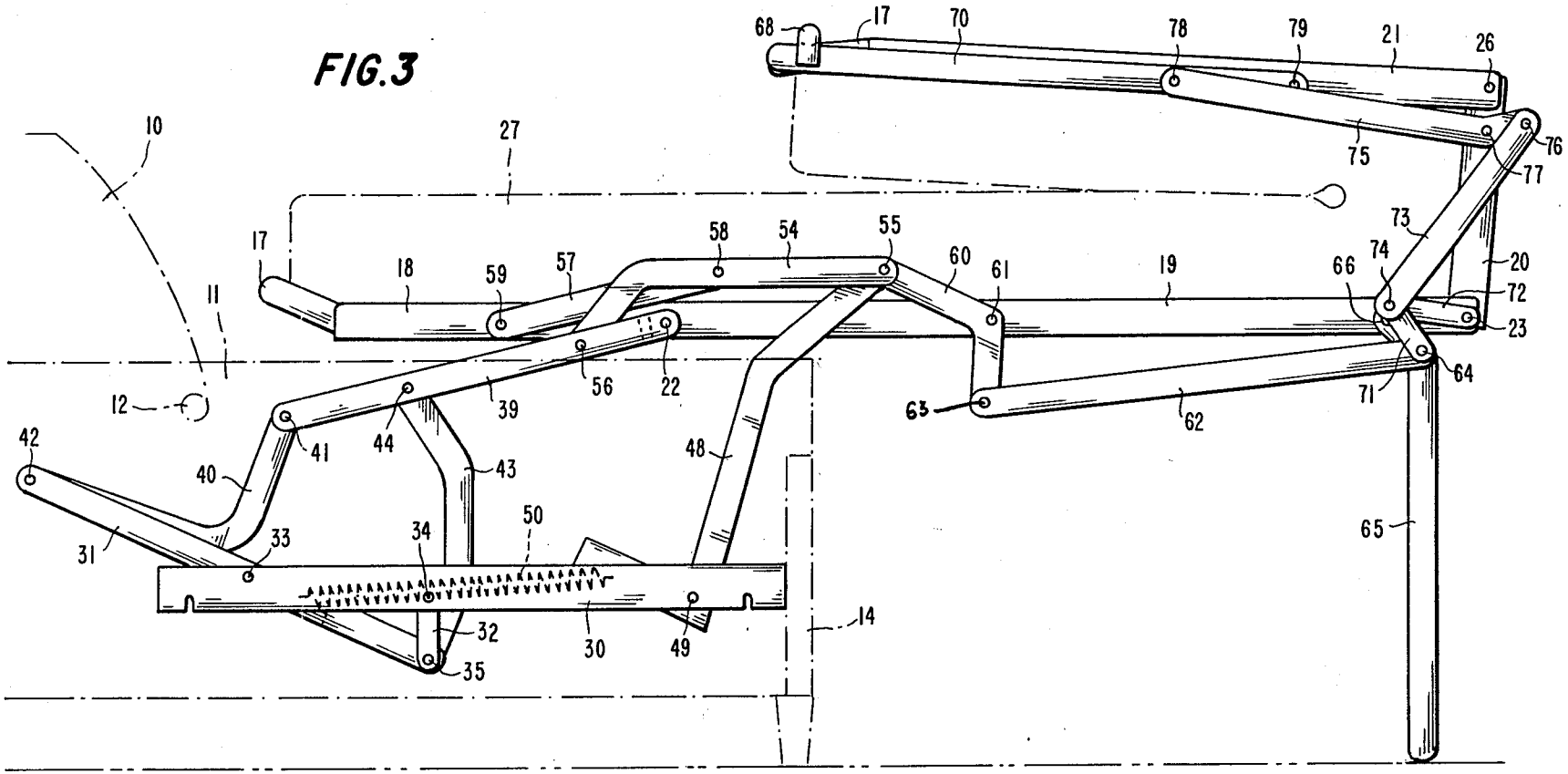
FIG. 3 is a view similar to FIG. 1 showing the rear and lower sections of the sofa-bed mechanism unfolded out of the sofa body, the front and upper sections still being folded, but partially releasing the pressure of the folded mattress on the upper section.

The sofa body shown in FIGS. 1–3 is schematically depicted because its structural and upholstery features are not material to an understanding of the invention, except for the presence of opposed side walls 11, an upholstered back 10, a crosspiece or breast rail 12 at the base of the back, and a one-piece immovable front board 14 extending along the entire length of the sofa.

The back 10 of the sofa body is hollow, and affords space for the rearward part of the mechanism, the mechanism being anchored to the sides 11 of the sofa body.

The sofa-bed mechanism comprises four sections pivoted to one another in succession, and a linkage for mounting the sectional unit within the sofa body. In the fully folded condition of the mechanism, the sections assume the relative positions shown in FIG. 1. It will be understood that these sections extend for substantially the full length of the sofa from one side 11 to the other, and that the pivotal anchorages of the mechanism to the sofa body are provided in duplicate, one at each side.

In the present mechanism, the sections comprise a rear section 18 (FIGS. 1 and 3) pivoted at its lower end 22 (as viewed in FIG. 1) to the lower horizontal section 19. The latter is pivoted at 23 to the front vertical section 20, and the latter is pivoted to the upper horizontal section 21 at 26. These pivotal connections permit the sections to lie in extended alignment when the mechanism is unfolded to its full extent, thus defining a bed. Each of the bed sections is preferably formed of opposed side rails connected at appropriate regions (as is well known) by braces extending parallel to the front board 14. The side rails are preferably angle members each of which has a horizontal flange and a vertical flange when the mechanism is extended into bed-defining condition. The free end of each of the rear vertical section 18 and the upper horizontal section 21 preferably consists of a tubular member 17 in the form of a U having short arms.

Extending across the sections 18–21 in known fashion is a bed spring (not shown), attached to them in any suitable manner. The spring supports a mattress 27 (FIG. 5) which is coextensive with the four sections and folds into the fully collapsed sofa-bed mechanism (FIG. 2). The mattress has an inherent resiliency which allows it to be folded into the collapsed sofa-bed mechanism, and which causes the mattress to spring open into a flat condition when not restrained by the folded mechanism. This inherent resiliency produces a constant upward pressure on the upper horizontal section 21 whenever that section is folded over lower horizontal section 19.

The four bed sections 18–21 of the mechanism are mounted within the sofa body by a supporting linkage pivotally connected between the bed sections and a horizontal bracket 30 fixed to the side 11 of the sofa body. An identical arrangement of supporting linkage and brackets is present at both sides of the sofa body, and hence only the arrangement at one side is illustrated and will be described. A bar 31, fixed to bracket 30 at 33, extends at an acute angle to the bracket, and a short bar 32, fixed to bracket 30 at 34, extends downwardly to a connection at 35 with the lower end of fixed bar 31. Thus, the portion of the bracket between connections 33 and 34, the portion of bar 31 between connections 33 and 35, and bar 32 constitute a rigid truss-like formation. Connections 33, 34, and 35 may conveniently be effected by rivets.

The supporting linkage includes a control link 39 pivotally connected at one of its ends to the pivotal connection 22 between the rear vertical section 18 and the lower horizontal section 19. A rear pivot link 40, having an L-shape, is connected at one of its ends to one end of control link 39 by a pivot 41. At its other end, rear pivot link 40 is connected to the upper end of fixed bar 31 by a pivot 42. A front pivot link 43 is connected at one of its ends to the lower ends of fixed bars 31 and 32 by a pivot connection at 35. The other end of front pivot link 43 is connected to control link 39 by a pivot 44 spaced from pivot 41. The terms "front" and "rear" as applied to the pivot links refer to their locations as closer to the front and rear of the sofa body, respectively.

Control link 30 and pivot links 40 and 43 constitute the arrangement for guiding the movement of the rear end 22 of lower horizontal section 19 as the mechanism moves between its fully folded condition (FIG. 1) to the fully unfolded condition of sections 18 and 19 (FIG. 3).

Movement of the mechanism from its collapsed condition of FIG. 1 to its partially unfolded condition of FIG. 3 is facilitated by an elevator arm 48 pivoted to bracket 30 at 49. A coiled tension spring 50 is connected between a short link 51 (FIG. 1), pivoted to the elevator arm at 52, and a point 53 on fixed bar 31. One end of elevator arm 48 is connected to one end of an actuating link 54 by a pivot 55, the other end of actuating link 54 being connected to control link 39 by a pivot 56. In the collapsed condition of the mechanism (FIG. 1), spring 50 urges elevator arm 48 in a clockwise direction. This force, transmitted to control link 39 through actuating link 54, helps to lift the folded mechanism of the sofa body.

Actuating link 54 and elevator arm 48 are connected by pivot 55 to one end of a bell crank 60, the latter being pivotally mounted on lower horizontal section 19 at 61. The other end of bell crank 60 is connected to one end of a rear leg control link 62 by a pivot 63. The opposite end of link 62 is connected by pivot 64 to a rear leg 65. Leg 65 is mounted on section 19 by a pivot 66 (FIG. 3).

A rear section support link 57 is connected at one end to actuating link 54 by a pivot 58, and at its other end to rear vertical section 18 by a pivot 59. As its name implies, this link serves to support section 18 in a horizontal plane when the sections are in their extended bed condition.

A front leg 70 is connected to upper horizontal section 21 by a pivot 79, the two front legs on opposite sides of the sofa-bed mechanism being joined together, for rigidity, by a tubular member 68. An upper horizontal section locking link 75 is connected at one of its ends to front leg 70, between the ends of the latter, by a pivot 78. At a point spaced from its other end, link 75 is connected to front vertical section 20 by a pivot 77. The end of locking link 75 extending beyond section 20 is connected by a pivot 76 to one end of a front vertical section locking link 73.

Prior to the present invention, the other end of locking link 73 was connected directly to lower horizontal section 19 by pivot 66, which joins leg 65 to section 19. According to the present invention, however, the lower end of link 73 (as viewed in FIGS. 1–3) is connected by a pivot 74 to one end of each of two links, namely, a lock operating link 71 and a lock control link 72. The other end of lock operating link 71 is connected by pivot 64 to leg 65 and leg control link 62. The other end of lock control link 72 is connected by pivot 23 to the joint between sections 19 and 20.

When the sofa bed mechanism is fully collapsed (FIGS. 1 and 2), locking link 75 and front leg 70 form a toggle mechanism which maintains upper horizontal section 21 in a horizontal orientation against upward pressure by the folded mattress 27 on the lower face of section 21 tending to rotate that section upward about pivot 26. The upward pressure of the mattress is resisted by the toggle lock 70, 75 as long as the longitudinal axis of locking link 75 is below pivot 79. Additionally, when the sofa-bed mechanism is fully collapsed, locking link 73 maintains the locked-together upper horizontal section 21 and front vertical section 20 against rotation about pivot 23; such rotation would otherwise result from upward pressure of folded mattress 27 on upper horizontal section 21.

In the past, when the sofa-bed mechanism was partially unfolded out of the sofa body, to the position of FIG. 3, this being accomplished by grasping and pulling the top of front vertical section 20 upwardly and outwardly, the relative orientations of bed sections 19, 20 and 21 remained unchanged, i.e., upper and lower sections 19 and 21 were both horizontal, and front section 20 was perpendicular to both (see FIG. 3 of U. S. Pat. No. 4,682,375). Consequently, the upward pressure of mattress 27 on upper section 21 was not changed from the condition of the mechanism shown in FIG. 1 to the condition shown if FIG. 3.

Figure 4:
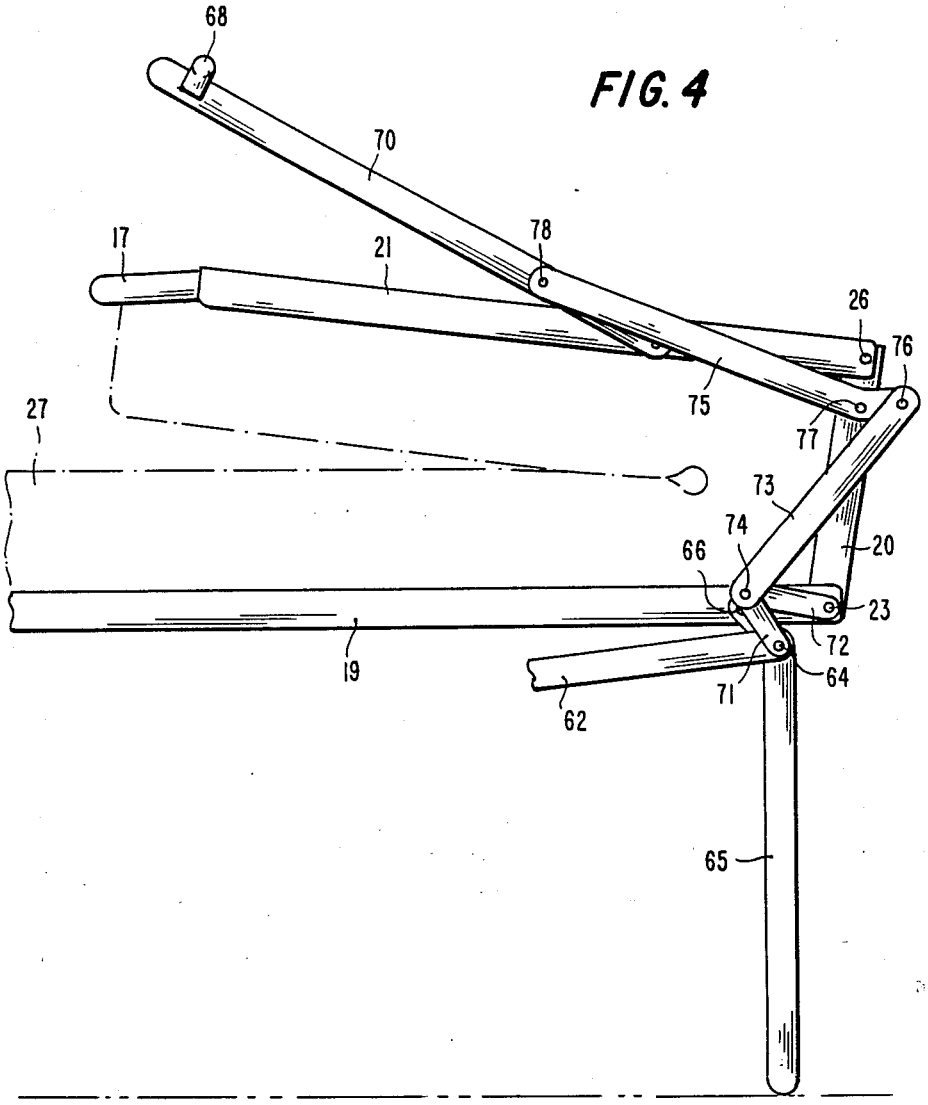
FIG. 4 is a view similar to FIG. 3 after the upper section locking arrangement has been locked, to release most of the mattress pressure, during the initial unfolding movement of the front and upper sections of the sofa-bed mechanism.
Figure 5:
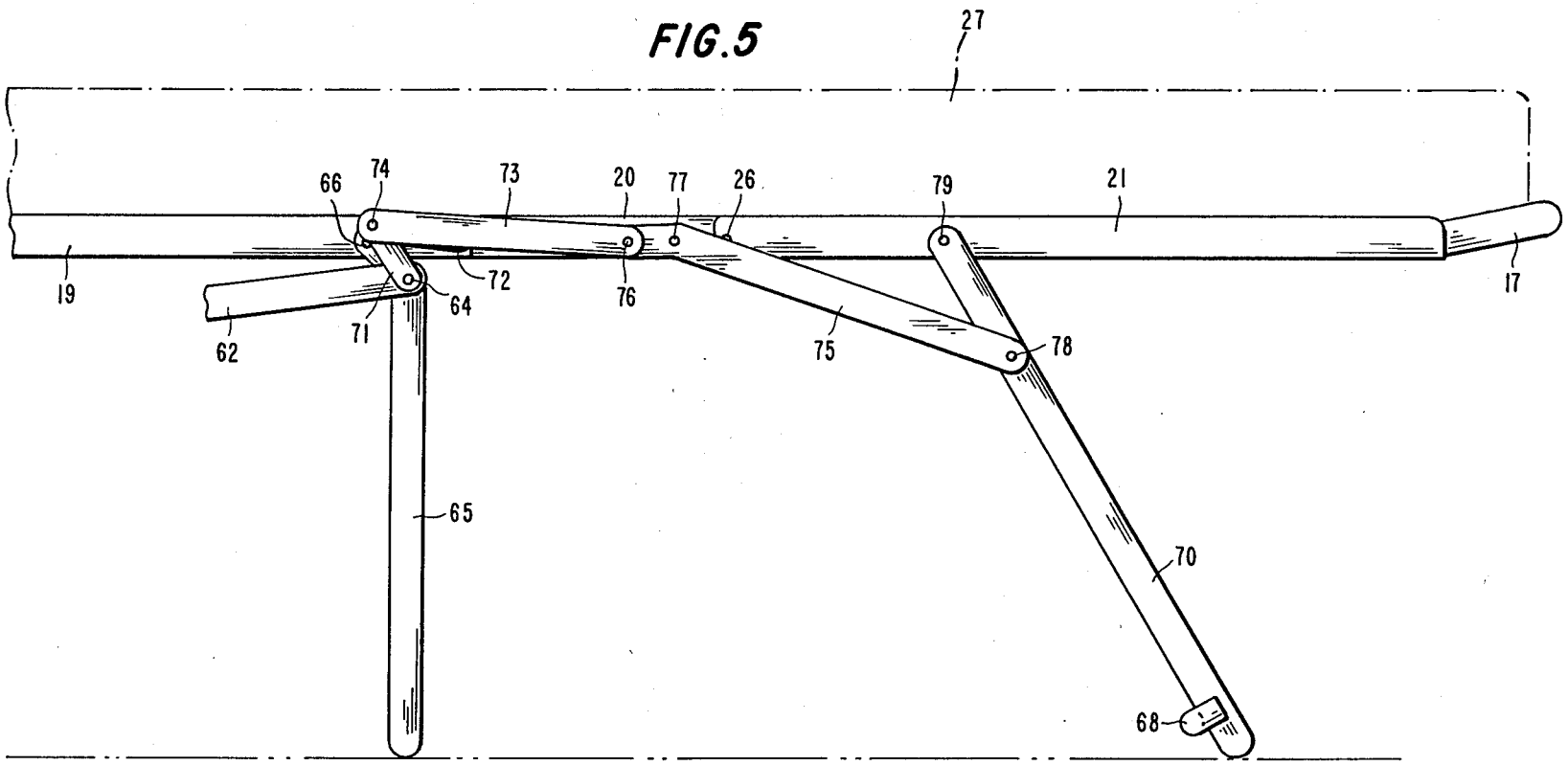
FIG. 5 is a side view of the lower, front, and upper sections of the fully extended sofa-bed mechanism.
Figure 6:
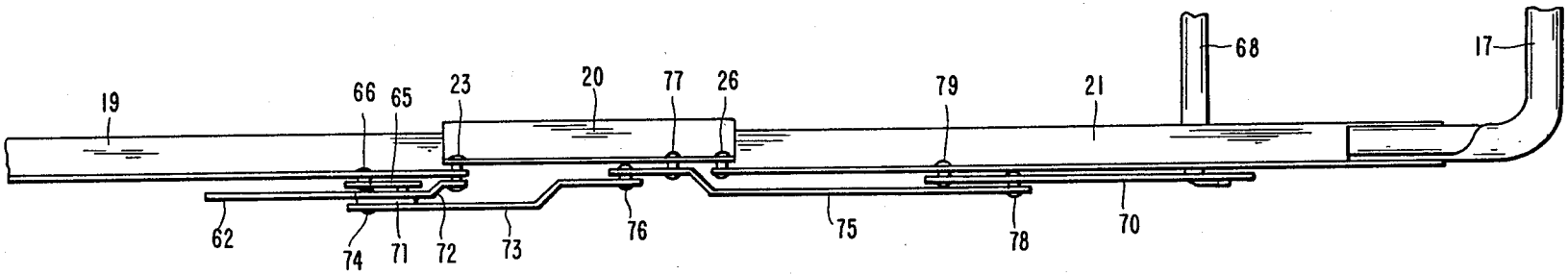
FIG. 6 is a top view of parts of the mechanism shown in FIG. 5.

The problem presented by this earlier arrangement involved the operation of toggle mechanism 70, 75 in order to further unfold the bed sections from their condition shown in FIG. 3 to the fully extended condition shown in FIGS. 5 and 6. In order to effect unlocking of the toggle mechanism, to permit relative rotation of sections 21 and 20 about pivot 26, tubular member 68 is pulled upwardly so as rotate front leg 70 and locking link 75 with respect to each other about pivot 78, to thereby cause link 75 to snap upwardly from a locked position below pivot 79 (FIG. 3) to an unlocked position above pivot 79 (FIG. 4). Once the parts are in the condition of FIG. 4, section 21 is free to unfold about pivot 26.

When tubular member 68 is first pulled upwardly, in FIG. 3, upper horizontal section 21 must initially swing downwardly through a small angle, about pivot 26, to permit locking link 75 to snap upwardly past pivot 78, into the FIG. 4 position. This initial downward movement requires that mattress 27 be further compressed, thereby adding significantly to the difficulty of initiating upward movement of member 68, i.e., the difficulty of unlocking toggle mechanism 70, 75.

This problem is overcome by the present invention. By comparing FIGS. 2 and 3, it will be seen that as rear leg rotates from its folded (FIG. 2) to its extended condition (FIG. 3), the leg causes rotation of lock operating link 71. As a consequence of this rotation of link 71, pivot 74 at the upper end of the link rises a short distance under the influence of lock control link 72. Elevation of pivot 74 raises front section locking link 73, which acts through the extension of link 75 and pivot 77 to rotate front section 20 about pivot 23, through a small angle in the direction of unfolding front section 20 with respect to lower section 19. Since upper section 21 remains locked to front section 20, by toggle arrangement 70, 75, throughout this movement, the rotation of front section 20 about pivot 23 causes upper horizontal section 21 to lift away from lower horizontal 19 (as shown in FIG. 3), thereby relieving some of the upward pressure of mattress 27 on section 21.

When tubular member is pulled upwardly in FIG. 3, upper section 21 must still rotate downwardly, about pivot 26, through a small angle to permit locking link 75 to snap upwardly past pivot 79. Now, however, the upward pressure that the mattress was exerting on the upper section in the FIG. 2 condition has been reduced by the time the mechanism reaches the position of FIG. 3. Consequently, the force used to open toggle lock 70, 75 has also been reduced, making unfolding of the bed from the condition of FIG. 3 through the condition of FIG. 4, to that of FIG. 5 much easier.

The angle through which sections 21 and 20 are rotated about pivot 23, during initial unfolding of the assembly from the FIG. 2 position to the FIG. 3 position is preferably of the order of five to ten degrees. This degree of rotation is usually enough to provide a sufficient relief of mattress pressure to have the desirable effect of easing the opening of toggle lock 70,75. If that angle of rotation is made too large, folding of the assembly from the FIG. 3 position to the FIG. 2 position becomes undesirably difficult.

Although front vertical section locking link 73 is shown connected to pivot 74, which also joins together lock operating link 71 and lock control link 72, locking link 73 could by pivotally connected to either of links 71 and 72 at a point intermediate the ends of the link.

The invention has been shown and described in preferred form only, and by way of example, and many variations may be made in the invention which will still be comprised within its spirit. Thus, although unfolding movement of rear leg 65 is shown as being transmitted to locking link 73 by means of links 71 and 72, other arrangements could be employed for this purpose. The important point is that locking link 73 be operatively connected to rear leg 65 so that unfolding movement of the latter is transmitted via locking link 73 to front vertical section 20 so as to cause the locked-together front vertical section 20 and upper horizontal section 21 to rotate about pivot 23. It is understood therefore, that the invention is not limited to any specific form or embodiment except insofar as such limitations are included in the appended claims.

I claim:

1. In a sofa-bed assembly having a series of sections pivoted to one another in succession, the sections being foldable between a collapsed sofa condition and an extended bed condition, and the series of sections including a rear vertical section, a lower horizontal section, a front vertical section, and an upper horizontal section, a mattress folded and compressed within the series of sections when the latter are in the collapsed sofa condition, the folded mattress pressing upwardly against the lower face of the upper horizontal section tending to pivot that section, with respect to the front vertical section, in the direction of unfolding of the section, a supporting linkage pivotally connected to the sections and constraining the latter to fold and unfold in accordance with a predetermined pattern of movement, that pattern involving the rear vertical section and lower horizontal section unfolding first after which the front vertical section and upper horizontal section unfold, when the sections move from their collapsed sofa condition to their extended bed condition, the supporting linkage including:

a rear leg movable between a folded condition, when the sections are in the collapsed sofa condition, and an unfolded condition in which it supports the lower horizontal section, when the rear vertical and lower horizontal sections are unfolded, an upper horizontal section locking means for preventing unfolding movement of the upper horizontal section due to upward pressure of the folded mattress on the upper horizontal section, the unlocking movement of said locking means serving to initially further compress the folded mattress after which the upper horizontal section is permitted to unfold, said initial further compression to the folded mattress adding to the force required to unlock the upper horizontal section for unfolding movement, and means responsive to unfolding of the rear leg for relieving some of the pressure of the folded mattress on the upper horizontal section, so as to reduce the force necessary to initially unlock said locking means.

2. A sofa-bed assembly as defined in claim 1 wherein said responsive means pivots the front vertical section with respect to the lower horizontal section, in a direction tending to unfold the latter two sections, while said locking means continues to prevent unfolding movement of the upper horizontal section.

3. A sofa-bed assembly as defined in claim 2 wherein said responsive means includes a front vertical section locking link for preventing unfolding movement of the front vertical section with respect to the lower horizontal section due to upward pressure of the folded mattress on the upper horizontal section, the vertical section locking link being operatively connected to the rear leg.

4. A sofa-bed assembly as defined in claim 2 wherein said responsive means includes links operatively connected between the rear leg and the front vertical section.

5. A sofa-bed assembly as defined in claim 4 wherein said links include a front vertical section locking link for preventing unfolding movement of the front vertical section with respect to the lower horizontal section due to upward pressure of the folded mattress on the upper horizontal section, and a lock operating link responsive to unfolding of the rear leg for shifting the locking link to pivot the front vertical section with respect to the lower horizontal section.

6. A sofa-bed assembly as defined in claim 5 wherein the rear leg is pivoted to the lower horizontal section, means for rotating the rear leg from a folded condition, when the series of sections is collapsed, to a supporting condition, when the series of sections is extended, said lock operating link being pivotally connected to the rear leg so that it responds to rotation of the rear leg for shifting the front vertical section locking link.

7. A sofa-bed assembly as defined in claim 6 including a lock control link pivotally connected between the lock operating link and the lower horizontal section, the front vertical section locking link being pivoted to at least one of the said lock operating and lock control links.

8. A sofa-bed assembly as defined in claim 7 wherein the vertical section locking link, the lock operating link, and the lock control link are pivoted together on a single pivot axis.

9. A sofa-bed assembly as defined in claim 7 including an upper horizontal section locking link pivotally connected between the front vertical section and the upper horizontal section, the front vertical section locking link being pivoted to the upper horizontal section locking link at a point remote from the point at which the front vertical section locking link is pivoted to one of the lock operating and lock control links.

* * * * *